United States Patent [19]

Brunel

[11] Patent Number: 4,840,162

[45] Date of Patent: Jun. 20, 1989

[54] FUEL INJECTION PUMP

[75] Inventor: Andre Brunel, St Genis Laval, France

[73] Assignee: Robert Bosch GmbH, Stuttgart, Fed. Rep. of Germany

[21] Appl. No.: 197,072

[22] Filed: May 10, 1988

[30] Foreign Application Priority Data

Jun. 13, 1987 [DE] Fed. Rep. of Germany ..... 3719831

[51] Int. Cl.[4] ..... F02M 39/00

[52] U.S. Cl. ..... 123/506; 123/450; 123/447

[58] Field of Search ..... 123/506, 458, 450, 501, 123/514, 447, 500; 417/462

[56] References Cited

U.S. PATENT DOCUMENTS

| | | | |
|---|---|---|---|
| 3,500,749 | 3/1970 | Kemp | 123/450 |
| 4,395,987 | 8/1983 | Kobayashi | 123/506 |
| 4,459,963 | 7/1984 | Gross | 123/501 |
| 4,546,749 | 10/1985 | Igashira | 123/506 |
| 4,574,759 | 3/1986 | LeBlanc | 123/450 |
| 4,601,274 | 7/1986 | Seilly | 123/447 |
| 4,625,694 | 12/1986 | Adey | 123/450 |
| 4,655,184 | 4/1987 | Eckert | 123/506 |
| 4,691,679 | 9/1987 | Lakin | 123/503 |
| 4,764,092 | 8/1988 | Thornwaite | 123/450 |

FOREIGN PATENT DOCUMENTS

| | | | |
|---|---|---|---|
| 3127543 | 1/1983 | Fed. Rep. of Germany | 123/506 |
| 0041462 | 3/1982 | Japan | 123/506 |

*Primary Examiner*—Carl Stuart Miller
*Attorney, Agent, or Firm*—Edwin E. Greigg

[57] ABSTRACT

In a fuel injection pump for internal combustion engines having at least one pump piston defining a pump work chamber and set into reciprocating motion by a cam drive for executing an intake stroke and a supply stroke, and having an electrical switching valve controlling the duration of supply and disposed in a relief line leading from the pump work chamber to a pump interior, a non-return valve having an opening direction toward the pump work chamber is disposed in a fuel inflow line connecting the pump interior with the pump work chamber in order to attain an emergency stoppage of the engine in the event the switching valve malfunctions. The valve element of the non-return valve is acted upon on one side by a valve closing spring and on the other by a fuel-filled control chamber, with which the valve element is locked in its closing position during the closed position of the switching valve.

20 Claims, 2 Drawing Sheets

FUEL INJECTION PUMP

BACKGROUND OF THE INVENTION

The invention is directed to improvements in fuel injection pumps for internal combustion engines.

This invention is an improvement upon a known fuel injection pump of this kind, embodied as a unit fuel injector and disclosed in German Offenlegungsschrift No. 35 23 536. In the known pump, the inflow line discharges with an inflow opening into the pump work chamber and is separated by the pump piston from the pump work chamber because of wear at the inflow opening. The instant the inflow opening opens is structurally defined and is determined by the distance of the inflow opening from bottom dead center of the pump piston.

The invention is a further improvement over a fuel injection pump of the radial piston type (German patent application No. P 36 12 942.9), in which the pump work chamber is defined by an annular groove on the rotating distributor piston; this annular groove communicates with fill grooves, which are distributed over the circumference of the distributor piston and are movable upon rotation of the distributor piston to communicate with fill bores in the distributor cylinder. The fill bores discharge into the fuel-filled pump interior and connect it to the pump work chamber whenever the fill grooves coincide with the mouths of the fill bores in the distributor cylinder.

In both of the above-described fuel injection pumps, the pump work chamber is always filled completely with fuel upon the intake stroke of the pump piston. The quantity of this fuel volume that attains injection is determined by the instant of closure and opening of the electric switching valve as a function of engine parameters, such as load and rpm. Upon closure of the switching valve, the fuel injection into the associated cylinder of the engine begins, while upon opening of the switching valve the pump work chamber is made to communicate with the relief chamber, thus abruptly terminating the fuel injection. If the switching valve malfunctions by sticking in the closed position and no longer opens, the fuel is always supplied with the maximum fuel injection quantity regardless of load, causing the engine rpm to increase uncontrollably, so that the engine "races".

OBJECT AND SUMMARY OF THE INVENTION

The fuel injection pump according to the invention has as its object and advantage over the prior art that if the switching valve becomes stuck in its closed position, the supply of fuel to the pump work chamber is automatically suppressed. Hence no fuel can be pumped from the pump work chamber to the injection valves, and the engine will come to a stop because of the lack of an ignitable mixture.

In distributor-type fuel injection pumps, the result is a substantially simpler distributor piston design, since the fill grooves and fill bores are dispensed with. Their absence has a favorable effect on the supply of fuel to the pump work chamber, because the leakage losses caused by the fill grooves do not occur. At the same time, there is less idle volume in the pump work chamber. The space required is small, because the additional non-return valve according to the invention can readily be integrated with the pump housing or even with the distributor piston.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
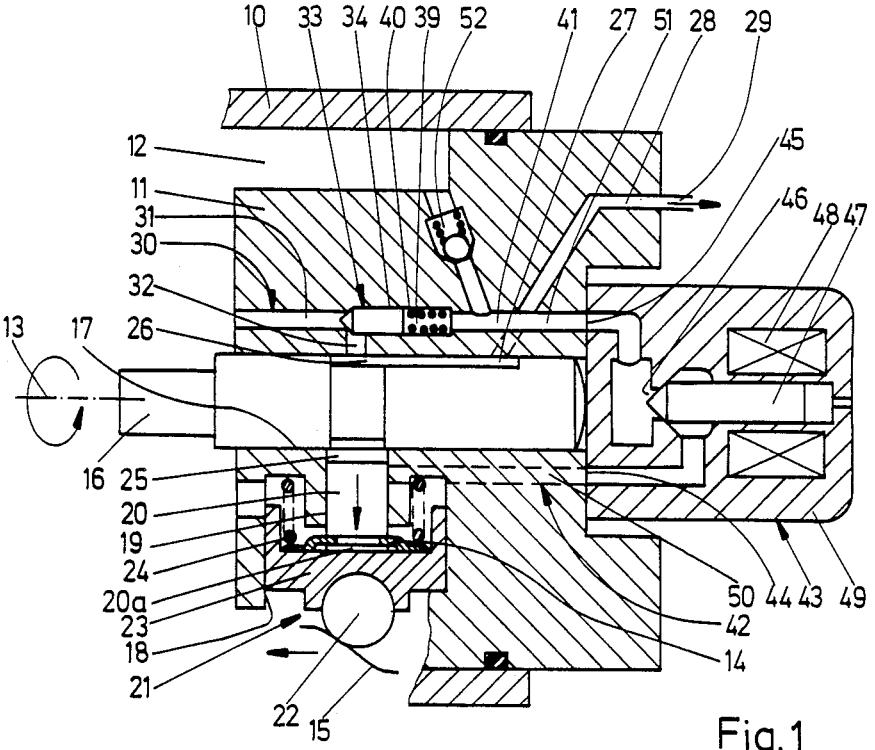
FIG. 1 is a detail view, in longitudinal section, of a distributor fuel injection pump of the radial piston type.

The distributor injection pump of the radial piston type shown in detail and in longitudinal section in FIG. 1 has a cup-shaped housing 10, only partly shown in FIG. 1, and a cap 11 that closes the housing, which is inserted from the open end of the housing 10 and with a bottom (not shown) of the housing 10 defines a pump interior 12. The pump interior 12 is filled with fuel at low pressure and serves as a fuel supply and relief chamber. A drive shaft 13, represented in FIG. 1 by its axis, is passed through the bottom portion of the housing 10. This drive shaft 13 widens in cuplike fashion in the pump interior 12 and along its edge has a cam ring, connected with it in a manner fixed against relative rotation. The cam race 15, provided on the inside of the cam ring, is shown schematically and rotated by 90° in FIG. 1. In a known manner, the cam race 15 has inwardly oriented cams, which are adapted in number and order to the number and order of radial pistons contained in the fuel injection pump and to the number of piston strokes to be executed with these radial pistons per rotation of the drive shaft 13. The feed pump, not shown, which fills the pump interior 12 with fuel is mounted on the drive shaft 13 in the usual manner.

Also joined to the drive shaft 13 n a manner fixed against relative rotation is a distributor piston 16, the axis of which is in alignment with the axis of the drive shaft 13. The distributor piston 16, except for the end connected to the drive shaft 13, is guided in a cylinder bore 17 in the cap 11 and is fixed in its axial position relative to the cylinder bore 17. Adjacent to the cam race 15 and radially inward from it, guides 18 are provided in the cap 11, which are distributed uniformly over the circumference and extend to near the distributor piston 16. For a distributor fuel injection pump as shown in FIG. 1, for supplying a total of three injection nozzles of an internal combustion engine, a total of three guides 18 are provided, only one of which is visible in FIG. 1. Radial bores 19 coaxial with the guides 18 are provided, and a pump piston 20 is guided longitudinally displaceably in each of the radial bores. A so-called roller tappet 21, comprising a cylinder or roller 22 and a tappet cup 23, is guided longitudinally displaceably in each of the guides 18. Like the cam race 15, the roller 22 is shown rotated by 90° in FIG. 1. A tappet spring 24 supported at one end on the bottom of the guide 18 and at the other end on a spring plate 14 resting on the bottom of the tappet cup 23 presses the tappet cup 23 against the roller 22 and presses the roller 22 against the cam race 15. The spring plate 14 is gripped from behind by a collar 20*a*, which protrudes out of the radial bore 19 of the pump piston 20 and thus fixes the pump piston 20 firmly on the tappet cup 23.

Each pump piston 20 defines a pump chamber 25 in the radial bore 19; the other face end of the pump chamber is formed by an annular groove 26 on the distributor piston 16. A distributor groove 27 which extends axially on the distributor piston 16 discharges in the annular groove 26. Three injection bores 28, which are uniformly distributed over the circumference of the cylinder bore 17, discharge in the cylinder bore 17 and lead through the cap 11 as far as a respective injection nozzle 29, represented in the drawing by an arrow. The axial length of the distributor groove 27 is such that it protrudes as far as the cross-sectional plane of the mouths of the injection bores and so makes one of the three injection bores 28, depending on the rotational position of the distributor piston 16, communicate with the annular groove 16.

Figure 2:
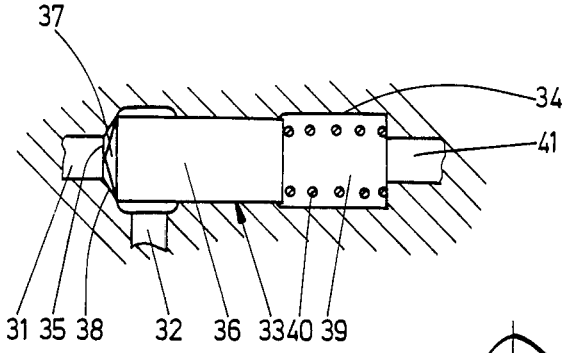
FIG. 2 is an enlarged view of a longitudinal section through a non-return valve in the fuel injection pump of FIG. 1.

Filling of the work chamber 25 with fuel from the pump interior 12 takes place during the intake stroke of the pump piston 20 via an inflow line 30 extending in the cap 11 and including a first bore section 31, extending in an axial direction with respect to the distributor piston 16, and a second bore section 32, extending radially with respect to the distributor piston 16. The first bore section 31 discharges in the pump interior 12, and the second bore section 32 discharges in the cylinder 17 in the vicinity of the annular groove 26 of the distributor piston 16. The two bore sections 31, 32 communicate with one another via a valve bore 34, which is provided in the cap 11 coaxially with and having a larger diameter than the first bore section 31. The mouth of the first bore section 31 in the valve bore 34 forms a valve opening 35 shown in FIG. 2 of a non-return valve disposed in the inflow line 30, the opening direction of the non-return valve 33 being toward the pump work chamber 25. The non-return valve 33, shown on a larger scale in FIG. 2, is embodied as a seat valve, which has a valve stem 36 located displaceably in the valve bore 34. On its face end oriented toward the valve opening 35, the valve stem 36 has a conical valve closing element 37, which for closing and uncovering the valve opening 35 cooperates with a valve seat 38 surrounding the valve opening 35. The face end of the valve stem 36 remote from the valve element 37 defines a control and spring chamber 39. A valve closing spring 40, embodied as a helical compression spring supported at one end on the face end of the valve stem 36 and at the other on the bottom of the valve bore 34 and which urges the valve stem 36 in the valve closing direction, is located in the control and spring chamber 39, which communicates via a bore section 41 with a relief line 42.

The relief line 42 extending in the cap 11 and divided into two bore sections 50, 51 discharges at one end in the pump interior 12 and at the other in the cylinder bore 17, in the vicinity of the annular groove 26 on the distributor bore 16. The relief line 42 includes an electromagnetic switching valve 43, by way of which the relief line 42 is blocked, which closes off the pump work chamber 25, or uncovered, which enables communication of the pump work chamber 25 with the pump interior 12 serving as a relief chamber. The structure and operation of the electromagnetic switching valve 43 are known, being described in German Offenlegungsschrift No. 35 23 536, for example. The two connections 44, 45 of the switching valve 43 communicate with one another via a valve opening 46 controlled by a valve element 47. The valve element 47 is actuated by an electromagnet 48; in the non-excited state of the electromagnet 48, the valve element 47 uncovers the valve opening 46, under the influence of a restoring spring, not shown, while in the excited state of the electromagnet 48 the valve element 46 closes the valve opening 48. The switching valve 43, which has a separate valve housing 49, is mounted on the cap 11, where it is secured in a suitable manner, closing the cylinder bore 17. The connection 44 then coincides with an end opening of the first bore section 50 of the relief line 42, while the second connection 45 coincides with an end opening of the second bore section 51 of the relief line 42. The mouth of the relief line 42 in the pump interior 12 is closed off with a check valve 52, which is connected with the second bore section 51 of the relief line 42. Specifically, the check valve 52 is located between the mouth of the relief line 42 in the pump interior 12 and the mouth, in the relief line 42, of the bore section 41 that connects the control chamber 39 of the non-return valve 33 with the relief line 42.

Figure 3:
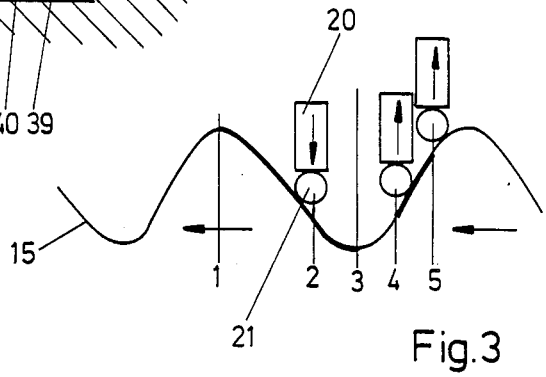
FIG. 3 is a detailed developed view of a cam path of a cam drive in the fuel injection pump of Fig. 1, intended to explain the mode of operation.

The mode of operation of the above-described fuel injection pump will now be described, referring to FIG. 3, which is a schematic, developed detail view of the cam race 15, which effects the intake stroke and pumping stroke of the pump piston 20.

On the descending flank of the cam race 15, which rotates with the drive shaft 13 and on which the roller tappet 21 rests, the associated pump piston 20 in FIG. 1 is moved outward. The switching valve 43 is not excited and hence is open. This intake stroke of the pump piston 20 takes place in the zone between top dead center (point 1 in FIG. 3) and bottom dead center (point 3 in FIG. 3). The suction or intake pressure produced in the pump work chamber 25 in this intake stroke causes the valve element 37 to lift from the valve seat 38, counter to the action of the valve closing spring 40, hence causing the non-return valve 33 to open. Fuel now flows out of the pump interior 12 via the inflow line 30 and the annular groove 26 on the distributor piston 16 into the pump work chamber 25, and from there into the relief line 42. At the end of the intake stroke (point 3 in FIG. 3), both the pump work chamber 25 and the entire relief line 42 are filled with fuel. Once the roller tappet 21 and hence the pump piston 20 have reached the bottom dead center position (point 3 in FIG. 3), then with the disappearance of the suction, the valve stem 36 of the non-return valve 33 is pressed with its valve element 37 onto the valve seat 38 (FIG. 2) by the valve closing spring 40, and the non-return valve 33 is closed. After passing through bottom dead center, the roller tappet 21 moves on the rising flank of the cam race 15, causing the pump piston 20 in FIG. 1 to move inward and execute its pumping stroke At the beginning of the pumping stroke, the switching valve 43 is still open, so that fuel flows out of the pump work chamber 25 back to the interior chamber 12 via the relief line 42 and the check valve 52. In the vicinity of the rising flank of the cam race 15, the distributor groove 27 connects the pump work chamber 25 with an associated injection bore 28. Once the roller tappet 21 has reached the position 4 in FIG. 3, the switching valve 43 is triggered, which closes it. Fuel is now pumped via the injection bore 28 to the injection nozzle 29, where it is injected into the cylinder of the engine.

To terminate fuel injection, the triggering of the switching valve 43 is ended, causing the valve to open again. This connects the pump work chamber 25, via the relief line 42 and the check valve 52, with the pump interior 12 serving as a relief chamber. The pressure in the pump work chamber 25 thus drops abruptly to below the opening pressure of the injection nozzle 29, which closes. Fuel injection is thus ended.

Any time the electromagnetic control for the switching valve 43 malfunctions, fuel injection is terminated, causing the engine to come to a stop because fuel is no longer being supplied. If the switching valve 43, despite being triggered, remains in its open position, then the pump work chamber 25 communicates continuously with the pump interior 12. A pressure that overcomes the opening pressure of the injection nozzle cannot build up in the pump work chamber 25. The injection nozzle 29 remains continuously closed. If the valve element 47 of the switching valve 43 sticks in its closing position, so that the switching valve 43 no longer opens despite the absence of excitation current, then the fuel-filled control chamber 39 is blocked by the closed switching valve 43 and blocks the opening movement, which typically begins at the intake stroke of the pump piston 20, of the valve stem 36 of the nonreturn valve 33. The non-return valve 33 can no longer open, and the pump work chamber 25 is no longer filled with fuel. Thus even upon the ensuing pumping stroke of the pump piston 20, no further fuel reaches the injection nozzle 29 via the distributor groove 27 and the injection bore 28. In this case as well, the engine comes to a stop because of the lack of fuel. The non-return valve 33 thus effects an automatic emergency stoppage of the engine if the electromagnetic switching valve 43 malfunctions.

In FIG. 2, the non-return valve 33 is shown on a larger scale. As this figure shows, the valve stem 36 and valve element 37 are embodied such that force components greater than the spring force of the valve closing spring do not arise at the surfaces of the valve stem 36 and valve element 37 acted upon by the pressure in the pump work chamber 25 during the pumping stroke of the pump piston 20, so that the switching valve 43 remains reliably closed during the pumping stroke of the pump piston 20. On the other hand, the surfaces of the valve element 37 and valve stem 36 acted upon by the fuel pressure in the pump interior 12 and by the suction in the pump work chamber 25 during the intake stroke of the pump piston 20 are matched to the force of the valve closing spring 40 in such a way that the non-return valve 33 reliably opens with the onset of the intake stroke of the pump piston 20 and remains open during the entire intake stroke.

Figure 4:
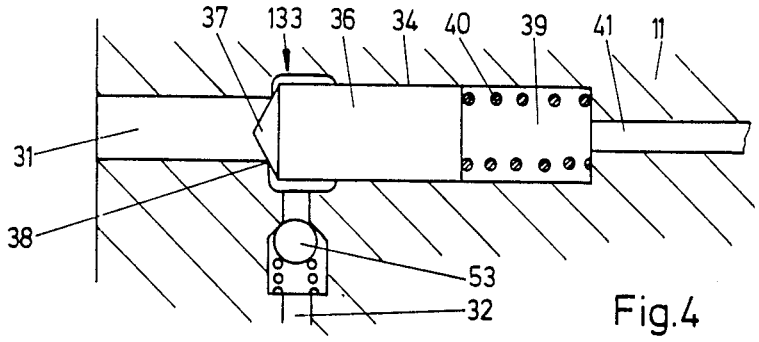
FIGS. 4 and 5 are each an enlarged view of a non-return valve in a longitudinal section through the fuel injection pump of FIG. 1, for a second and third exemplary embodiment, respectively.

In the further exemplary embodiment of a non-return valve 133, likewise embodied as a seat valve, shown in FIG. 4, a check valve 53 the opening direction of which is toward the pump work chamber 25 is disposed in the radial bore section 32 of the inflow line 30, between the valve bore 34 and the annular groove 26 in the distributor piston 16. This check valve 53 simplifies the design of the non-return valve 33, because the pumping pressure in the pump work chamber 25 no longer need be taken into account in designing the surfaces of the valve element 37 that are acted upon by the pressure.

Figure 5:
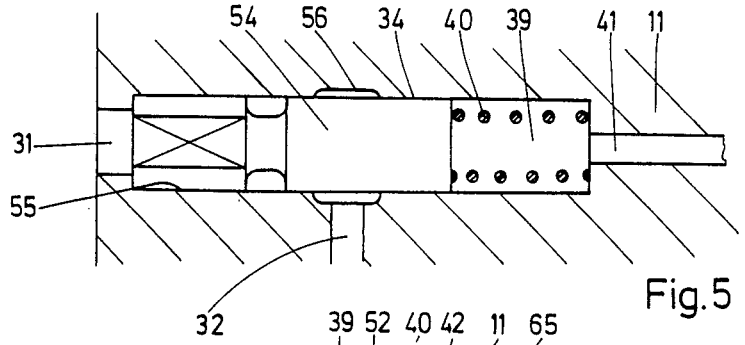

In the further exemplary embodiment of the non-return valve of FIG. 1 shown in FIG. 5, the non-return valve 233 is embodied as a spool valve; a valve piston 54 slides in the valve bore 34, urged by a valve closing spring 40 in the same manner as the valve stem in FIGS. 1 and 2. The valve piston 54 divides the valve bore 34 into a front valve chamber 55, in which the first bore section 31 of the inflow line 30 discharges, and a rear valve chamber forming the control and spring chamber 39, which as in FIGS. 1 and 2 communicates with the relief line 42 via the bore section 41. The radial bore section 32 of the inflow line 30 discharges in an annular groove 56 provided approximately in the middle of the valve bore 34. With its piston surface, the valve piston 54 closes the annular groove 56, in the blocking position of the non-return valve 233 as shown in FIG. 5, and after a predetermined displacement travel partly uncovers this groove again, counter to the force of the valve closing spring 40, so that the first bore section 31 of the inflow line 30 now communicates via the valve chamber 55 with the second bore section 32 of the inflow line 30.

Figure 6:
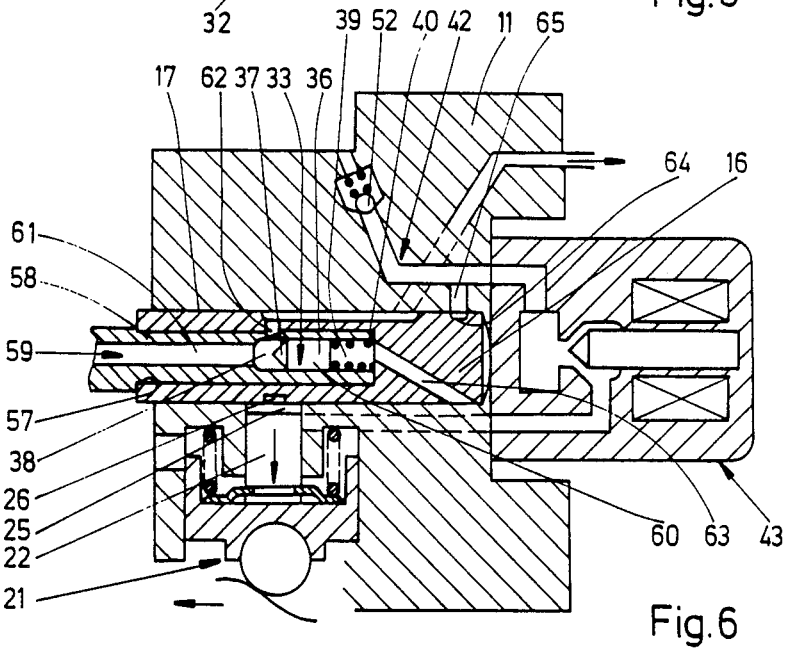
FIG. 6 is a detail of a longitudinal section of the fuel injection pump in a further exemplary embodiment.

The further exemplary embodiment, shown in FIG. 6, of a distributor fuel injection pump of the radial piston type differs from the fuel injection pump of FIG. 1 only in that the non-return valve 33 is integrated with the distributor piston 16. To this end, the distributor piston 16 has a blind bore 57, into which a sleeve 58 provided with an internal stepped bore 59 is introduced. The bore section 60 having the larger diameter of the internal stepped bore 59 is adjacent to the bottom of the blind bore 57 and communicates with the annular groove 26 on the distributor piston 16 via a bore 62 radially penetrating the sleeve 58 and the distributor piston 16. The second bore section 60 also communicates, via an inclined bore 63 discharging at the bottom of the blind bore 57, with a further annular groove 64, which is disposed on the distributor piston 16 spaced apart from the annular groove 26 that defines the pump work chamber 25. A tie bore 65 extending as far as the second bore section 51 of the relief line 42 receives fuel from the cylinder bore in the vicinity of the annular groove 64. The valve tappet 36 of the non-return valve 33, which is again embodied as a seat valve and is identical to that shown in FIG. 1, is axially displaceable in the first bore section 60. The transition step between the two bore sections 60, 61 is embodied as a valve seat 38, which cooperates with the conical valve element 37 on the valve stem 36. The face end of the valve stem 36 remote from the valve element 37 again defines the control and spring chamber 39, in which the valve closing spring 40 is located and which communicates continuously with the relief line 42, via the inclined bore 63, the annular groove 64 and the tie bore 65. The bore section 61 of the internal stepped bore 59 having the smaller diameter communicates with the pump interior 12 and together with the bore 62 forms the inflow line 30. The remaining structure and the mode of operation of the fuel injection pump of FIG. 6 are as described in conjunction with FIG. 1, and so the same reference numerals are assigned to identical components.

The invention is not limited to the exemplary embodiments of a distributor fuel injection pump having a radial piston as described above. It can equally well be used in distributor fuel injection pumps having axial pistons, like those described in German Offenlegungsschrift No. 35 11 492, or in fuel injection pumps of the unit fuel injector type, like those described in German Offenlegungsschrift No. 29 03 482.

The foregoing relates to preferred exemplary embodiments of the invention, it being understood that other variants and embodiments thereof are possible within the spirit and scope of the invention, the latter being identified by the appended claims

What is claimed and desired to be secured by Letters Patent of the United States is:

1. A fuel injection pump for internal combustion engines having a pump interior, at least one pump piston defining a pump work chamber, said pump piston adapted to be driven reciprocatingly to execute an intake stroke and a supply stroke, wherein upon said intake stroke said pump work chamber is filled with fuel via an inflow line from a fuel supply chamber in said pump interior, and upon the supply stroke the fuel is pumped out of the pump work chamber to an adjoining injection nozzle, an electric switching valve which controls a duration of pumping, said electric switching valve being disposed in a relief line leading from said pump work chamber to a relief chamber in said pump interior, and said switching valve on closing defines the supply onset and by opening defines the end of supply, a non-return valve (33; 133; 233) having an opening direction toward said pump work chamber (25) being disposed in an inflow line (30) between said fuel supply chamber (12) and said pump work chamber (25), said non-return valve including a valve element, a valve closing spring (40) for urging said valve element (37) in a closing direction and a fuel-fillable control chamber (39) adapted, when filled with fuel, to lock said valve element (37) in its closing position, said control chamber (39) communicating with a section (52) of a relief line (42) located between said switching valve (43) and the relief chamber in the pump interior, and said relief line (42) is closed off toward the relief chamber (12) by a check valve (52) so oriented that its opening direction is toward the relief chamber.

2. A pump as defined by claim 1, in which said valve closing spring (40) and a surface of said valve element (37) acted upon by the fuel pressure are adapted to one another such that said non-return valve (33; 133; 233) opens upon an intake stroke of the pump piston (20) and closes upon a supply stroke of the pump piston.

3. A pump as defined by claim 1, in which said non-return valve (33; 133) is embodied as a seat valve having a valve stem (36) which slides in a valve bore (34), said valve stem including said valve element (37) having a conical end cooperating with a valve seat (38) penetrated by a valve opening (35) to an inflow line (30), said valve stem defining with its face end remote from said valve seat a bore section forming said control chamber 39 within a valve bore (34), said valve closing spring (40) being received in said control chamber (39), and said control chamber (39) is connected to said relief line (42) via a connecting bore (41; 63, 64, 65).

4. A pump as defined by claim 2, in which said non-return valve (33; 133) is embodied as a seat valve having a valve stem (36) which slides in a valve bore (34), said valve stem including said valve element (37) having a conical end cooperating with a valve seat (38) penetrated by a valve opening (35) to an inflow line (30), said valve stem defining with its face end remote from said valve seat bore section, forming said control chamber 39 within a valve bore (34), said valve closing spring (40) being received in said control chamber (39), and said control chamber (39) is connected to said relief line (42) via a connecting bore (41; 63, 64, 65).

5. A pump as defined by claim 3, in which a surface end of said valve element (37) of said non-return valve (33) acted upon during a supply stroke of said pump piston (20) by the pressure in the pump work chamber (25) is embodied such that said valve opening (35) remains closed even when injection pressure prevails in the pump work chamber (25).

6. A pump as defined by claim 4, in which a surface end of said valve element (37) of said non-return valve (33) acted upon during a supply stroke of said pump piston (20) by the pressure in the pump work chamber (25) is embodied such that said valve opening (35) remains closed even when injection pressure prevails in the pump work chamber (25).

7. A pump as defined by claim 3, in which a check valve (53), having an opening direction toward the pump work chamber (25) is disposed in section (32) of said inflow line (30) located between said valve opening (35) of the non-return valve (133) and the pump work chamber (25).

8. A pump as defined by claim 4, in which a check valve (53) having an opening direction toward the pump work chamber (25) is disposed in a section (32) of said inflow line (30) located between said valve opening (35) of the non-return valve (133) and the pump work chamber (25).

9. A pump as defined by claim 1, in which said non-return valve (233) comprises as a spool valve having a valve piston (54) axially displaceable in a valve bore (34), with which piston a first line section (31) discharges in the valve bore (34) leading to the fuel supply chamber (12) and a second line section (32) is controlled for communication therewith, one face end of said valve piston (54) defining a bore section (55) into which said first line section (31) discharges, the other face end of said valve piston (54) defining a bore section forming said control chamber (39) for communicating with said relief line (42) via a connecting bore (41).

10. A pump as defined by claim 2, in which said non-return valve (233) comprises a spool valve having a valve piston (54) axially displaceable in a valve bore (34), with which piston a first line section (31) discharges in the valve bore (34) leading to the fuel supply chamber (12) and a second line section (32) is controlled for communication therewith one face end of said valve piston (54) defining a bore section (55) into which said first line section (31) discharges, the other face end of said valve piston (54) defining a bore section forming said control chamber (39) for communicating with said relief line (42) via a connecting bore (41).

11. A pump as defined by claim 1, in which said non-return valve (33; 133; 233) is disposed in a cap (11).

12. A pump as defined by claim 2, in which said non-return valve (33; 133; 233) is disposed in a cap (11).

13. A pump as defined by claim 3, in which said non-return valve (33; 133; 233) is disposed in a cap (11).

14. A pump as defined by claim 5, in which said non-return valve (33; 133; 233) is disposed in a cap (11).

15. A pump as defined by claim 7, in which said non-return valve (33; 133; 233) is disposed in a cap (11).

16. A pump as defined by claim 9, in which said non-return valve (33; 133; 233) is disposed in a cap (11).

17. A pump as defined by claim 1, which includes a rotating distributor piston for supplying a plurality of injection nozzles, and said non-return valve (33) is integrated with said distributor piston (16).

18. A pump as defined by claim 2, which includes a rotating distributor piston for supplying a plurality of injection nozzles, and said non-return valve (33) is integrated with said distributor piston (16).

19. A pump as defined by claim 3, which includes a rotating distributor piston for supplying a plurality of injection nozzles, and said non-return valve (33) is integrated with said distributor piston (16).

20. A pump as defined by claim 17, in which a stepped blind bore (57, 58, 59) is provided in said distributor piston (16), said stepped blind bore including a front bore section (61) and a larger diameter rear bore section (60), said non-return valve (33) being located axially displaceable in said rear bore section (60) having the larger bore diameter and located on a blind bore bottom, a valve closing spring being disposed supported on the blind bore bottom to act on a face end of said non-return valve (33), a portion of the rear bore section (60) defined by the face end of said non-return valve and oriented toward the blind bore bottom being adapted to communicate with an annular groove (64) of a surface of said distributor piston (16) via a bore (63) communicating with a bore (65) leading to said relief line (42), and the portion of the rear bore section (60) defined by the end face of said non-return valve piston remote from the blind bore bottom communicates with said pump work chamber (25) via a bore (62) which together with said front bore section (61), defines having the smaller bore diameter, of the blind bore (57, 58, 59) forms said inflow line (30).

* * * * *